United States Patent [19]

Wurzer et al.

[11] Patent Number: 5,058,171

[45] Date of Patent: Oct. 15, 1991

[54] MICROPHONE ARRANGEMENT

[75] Inventors: Josef Wurzer, Vienna; Konrad Wolf, Bad Vöslau, both of Austria

[73] Assignee: AKG Akustische u. Kino-Geräte Gesellschaft m.b.H

[21] Appl. No.: 557,939

[22] Filed: Jul. 26, 1990

[30] Foreign Application Priority Data

Jul. 26, 1989 [AT] Austria ..... 1803/89

[51] Int. Cl.[5] ..... H04R 3/00

[52] U.S. Cl. ..... 381/92; 381/94

[58] Field of Search ..... 381/92, 95, 111, 94, 381/114, 115, 122

[56] References Cited

U.S. PATENT DOCUMENTS 4,334,740 6/1982 Wray ..... 381/92
4,653,102 3/1987 Hansen ..... 381/92
4,888,807 12/1989 Reichel ..... 381/92

FOREIGN PATENT DOCUMENTS 248514 8/1966 Austria .
3146945 8/1982 Fed. Rep. of Germany .
0170157 7/1989 Japan ..... 381/94
1233457 5/1971 United Kingdom .

*Primary Examiner*—Jin F. Ng
*Assistant Examiner*—Sylvia Chen
*Attorney, Agent, or Firm*—Toren, McGeady & Associates

[57] ABSTRACT

A microphone arrangement comprising at least two individual microphones arranged closely next to each other, whose individual microphones depending on the recording angle desired for the sound recording are a pressure- and/or a pressure gradient receiver and/or a directional line microphone, is characterized by the wind pressure being continuously measured during the sound recording by means of a microphone (Mw) with downstream switched electronic circuit (5, 11, 12) and depending on the respectively prevailing wind pressure always that microphone (M1, M2, Mn) remains switched to the amplifier 9 assigned to it by an instantaneously controlled switch (6, 7, 8), which in its conversion principle, frequency course and its directional effect is least sensitive to wind noises for the prevailing wind intensity.

4 Claims, 2 Drawing Sheets

MICROPHONE ARRANGEMENT

BACKGROUND OF THE INVENTION

The invention is directed to a microphone arrangement comprising at least two individual microphones arranged in proximity of each other. Depending on the recording angle desired for the sound recording, a pressure, pressure gradient, or directional line microphone is used as individual microphones.

For outdoor sound recording, especially for video and film shooting, microphone arrangements of many different designs are used, wherein also those with a designation vario- or zoom microphone imitating the camera lens arrangements used concurrently with them have become known.

A microphone combination is known from the AT-PS 248 514, where the one of the two individual microphones has a pickup pattern of a slender lobe, the other has a one-sided pickup pattern providing a larger preferably changeable angle of aperture. Possibly the second microphone can also be a pressure receiver with a spherically-shaped pickup pattern. Such a microphone arrangement creates the possibility of changing the sound pickup angle within wide limits. Sound events prevailing within the receiving region of the optics can be effectively recorded while interference noise existing outside of the receiving region is blanked out.

The GB-PS 1 233 457 describes a microphone combination for video and movie shooting, where electronic filters are utilized for improved erasure of the sound incident below an angle 180° to the receiving direction; such electronic filters transmit only the signals received by the pressure gradient receiver directed to one side for the low frequency transmission spectrum, however, they accept only the signals of the directional line microphone for overall reproduction or playback for the transmission spectrum of the middle and high frequencies.

A sound recording microphone for video- and movie shooting is mentioned in DE-OS 31 46 945, where the variable directional effect is changed together with the variable object. An intervention element arranged in the camera permits selective automatic coupling or manual actuation of the device for changing the direction of the microphone and the zoom actuation arrangement.

The sound recordings recorded simultaneously with, for instance, outdoor video and movie shooting are always impaired by noise caused by the presence of wind. Also they are often jammed for a short time, which means a reduction in the sound quality of the sound material recorded together with the picture. In some cases the original sound can no longer be reconstructed, and a dubbing is not true to the original. The interference noise caused by the wind is not always the same. It is determined by the strength of the wind, the direction of incidence of the wind and also by the type of microphone used. The wind protection devices attached to the microphone arrangement or to the individual microphone provide only conditional help, since they do not generally exclude wind noises, rather they only weaken them to a slight extent.

Outdoor sound and tone recordings in wind condition are always difficult, because protection against occurrence of interference noises is only possible by means of very large wind protection devices, which because of their size are to be viewed as interference objects for the recording, wherein also such wind protection does not always avoid the excessive control of the microphone and amplifier. Limiters arranged in the amplifier respond repeatedly and also impair the tonality. The directional microphones preferably used for tone recording are also particularly prone to interference noises caused by sound generated by wind.

Therefore one is faced with the task of creating such an arrangement which assures in case of outdoor sound and tone recording in the presence of wind, that interference noises due to the wind do not appear on the sound track, so that the quality of the recorded tone or sound material is maintained.

SUMMARY OF THE INVENTION

This task is solved in the invention by the following means:

The wind pressure is continuously measured during the sound recording by a microphone with downstream electronic circuit and depending on the respectively prevailing wind pressure the microphone always remains at the amplifier assigned to it by means of a switch controlled in a delay-free manner, which amplifier corresponding to its conversion principle, frequency course and its directional effect is least sensitive to the noises caused by the wind at the prevailing wind intensity.

The continuous measurement of the wind pressure by means of a microphone must also be accomplished without delay, for which reason a hot wire anemometer cannot be envisaged as a wind pressure sensor, because it has too high an inertia due to its thermal mode of operation. Rather the use of a microphone by way of a wind pressure receiver will result in correspondingly instantaneous measuring values. Not only can such a microphone be fabricated at low cost, but because of its small size can be placed simply and unobtrusively near the microphone used for the sound recording. A miniature capacitor microphone is particularly suited for this task.

The air flow generated by the wind produces an equivalent wind sound pressure at the measuring microphone, whose voltage, compared with a reference voltage, is supplied proportionally thereto by the microphone. When a predetermined voltage level is exceeded which corresponds to a very specific wind flow, the microphone which is most sensitive to wind noises is disconnected from its assigned amplifier by means of an electronic arrangement, while the microphone insensitive to wind noises is connected to its assigned amplifier and remains switched thereto. The advantage for the sound recording consists in that, if the wind tentatively fluctuates, the recording correspondingly occurs with that microphone, which does not transmit any wind noises, whereby the recorded sound material remains free of interference noises.

Preferably the microphone measuring the wind pressure is a pressure microphone, because in most cases such a microphone is entirely adequate for measuring the equivalent wind sound pressure. The advantage of such a microphone is that it can be manufactured in the simplest way, and thus represents the least costly embodiment form for the intended use.

For sound recordings, which are fraught with special problems because of the interferences caused by wind noises, a pressure microphone is not always adequate. In such cases it is advisable according to another feature of the invention to provide a pressure gradient receiver by way of the microphone measuring the wind pressure, preferably one with cardiod or heart-shaped directional effect. Pressure gradient receivers are particularly sensitive to wind because of their physical property as elastically functioning converters with an inhibited characteristic and with deep natural resonance, wherein they are eminently suitable as wind sensors. Compared to a pressure receiver or microphone they are indeed more expensive, so that their use must only be preferred in critical recording cases.

Another version of the invention consists in that the microphone measuring the wind pressure is a microphone forming part of the microphone arrangement itself. This embodiment is always advantageous if a wind pressure sensor proper must be dispensed with because of cost considerations, or insufficient space exists to house an additional microphone measuring the wind pressure next to the microphone arrangement.

BRIEF DESCRIPTION OF THE DRAWINGS

The invention is described with the help of two block diagrams.

DETAILED DESCRIPTION OF THE PREFERRED EMBODIMENT

Figure 1:
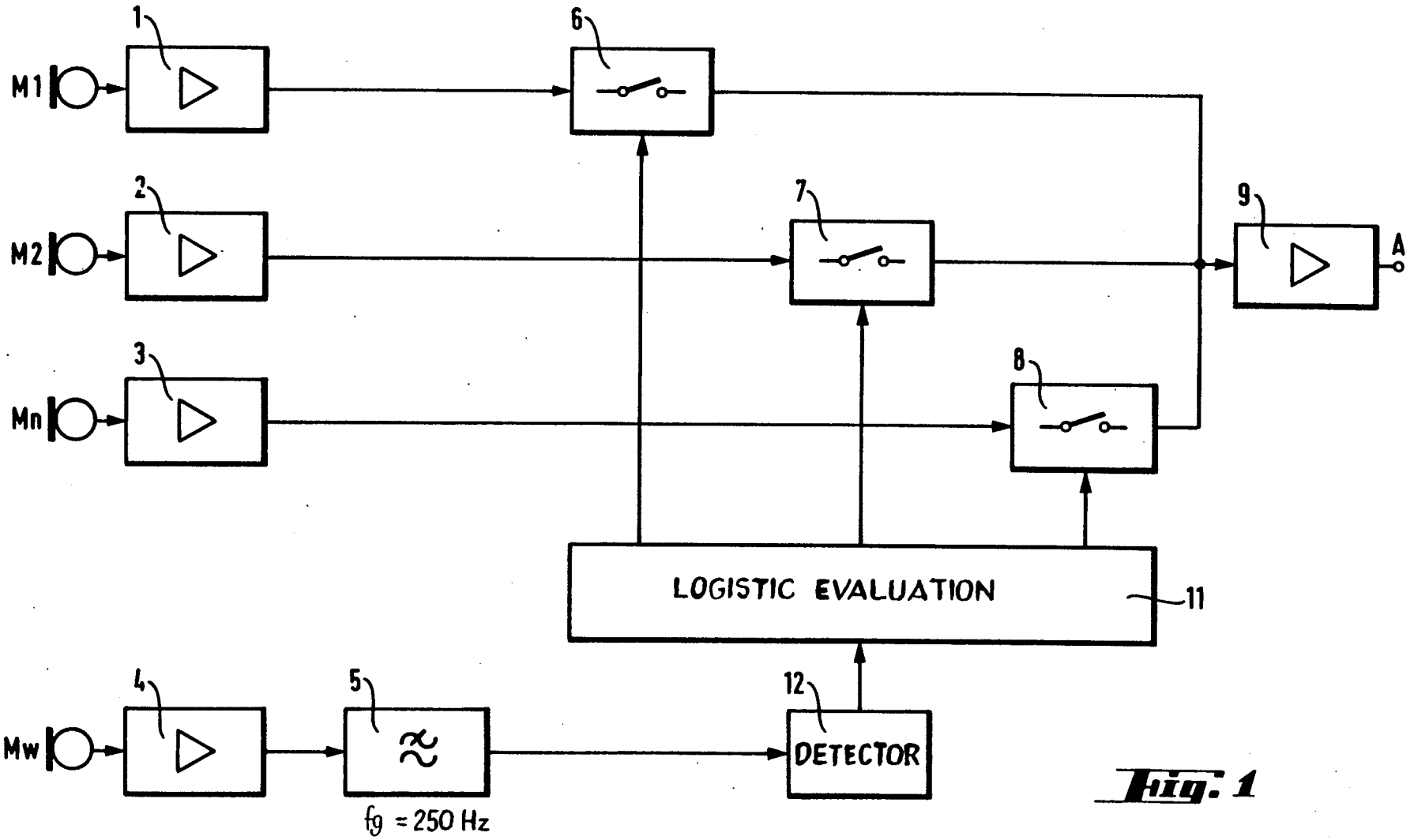
FIG. 1 shows the circuit for a microphone arrangement consisting of more than two microphones and FIG. 2 shows such an arrangement consisting of only two microphones.

The microphone measuring the wind pressure in the invention is designated by Mw in FIG. 1. The voltage proportional to the wind flow and to the equivalent wind sound pressure generated by the microphone Mw is amplified in the preamplifier 4, to be filtered in the low pass filter 5 to frequency shares up to approximately 250 Hz. These low frequency voltage shares from wind noise are fed to an electronic circuit 11, 12, which determines the wind intensity at the microphone Mw in a detector 12 and by means of a logistic evaluation 11 switches on respectively that switch 6, 7, 8, which switches respectively that microphone M1, M2, Mn to the amplifier which is least sensitive to the prevailing wind intensity, with an interference free recording signal thus being present at the output A of the amplifier. In a microphone arrangement consisting of individual microphones the microphone Ml is preferably a pressure receiver with spherically-shaped direction effect and the microphone Mn is a directional line microphone with lobe-shaped directional effect. However, an arrangement is also conceivable where additional microphones Mn are provided, as for instance a pressure gradient receiver with hypercardiod-shaped directional effect and only then a directional line microphone. If capacitor microphones are used as microphones in the microphone arrangement, amplifiers 1, 2, 3 are required for preamplification. The switches 6, 7, 8 are generally designed to be electronic switches and are actuated in such a way by the logistic evaluation 11, that the switchover from microphone to microphone is performed without any clicks occurring.

Figure 2:
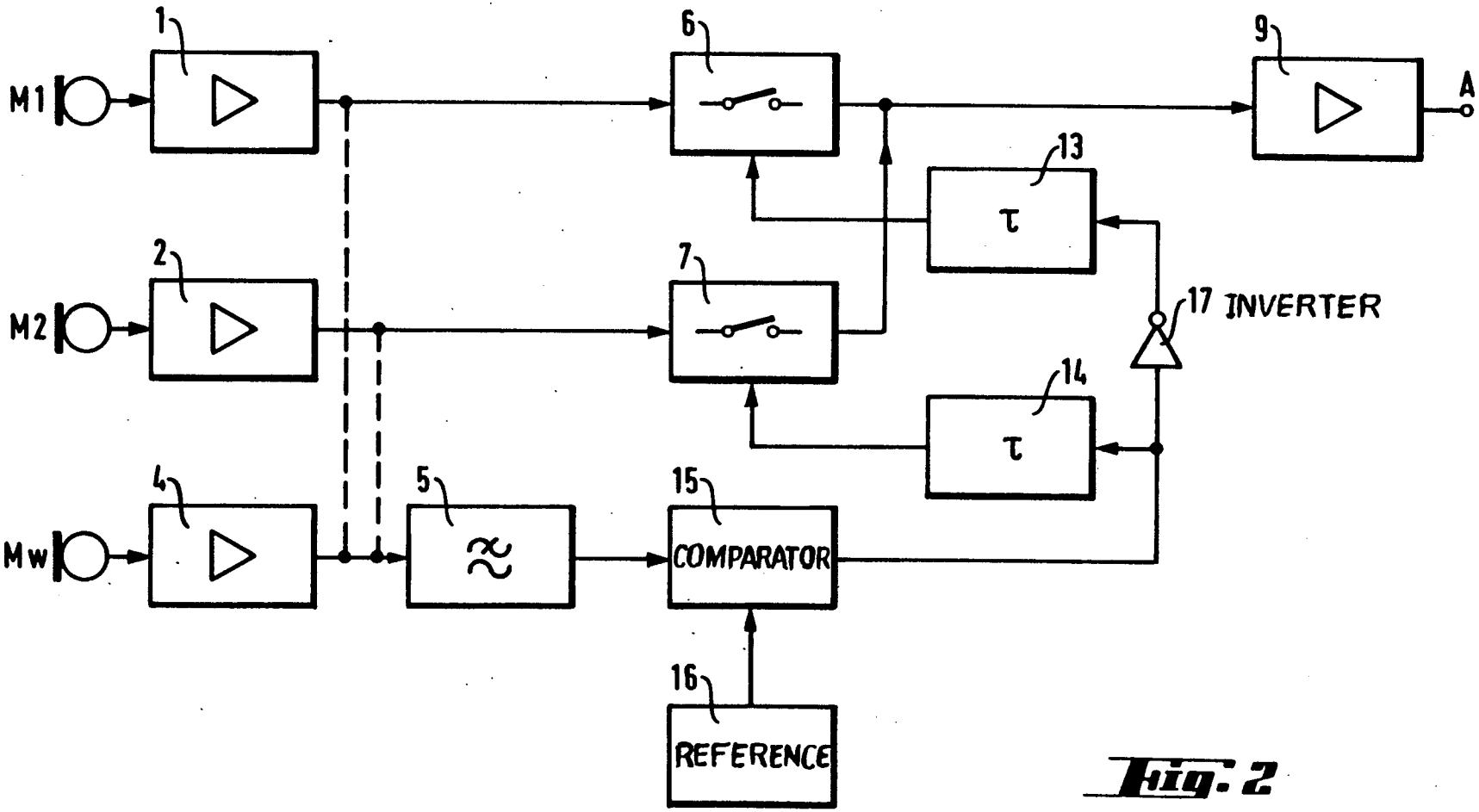

A simplified version is shown in FIG. 2. The microphone Mw measuring the wind pressure and its preamplifier 4 apply the voltage proportional to the wind pressure filtered in the low pass filter 5 with a limit frequency of 250 Hz, to a comparator 15 which compares this voltage generated by the microphone Mw with a reference voltage 16. If a wind pressure results in wind noises critical for one of the two microphones M1 and M2 occurs, the respective wind sensitive microphone is switched off. The time delay units 13, 14 designated with $\tau$ have the task to initiate a click-free switching. In the invention the microphone Mw measuring the wind pressure can be a microphone in the microphone arrangement itself, which means that the microphone Mw assumes the place of the microphone M1 or M2. In the block diagram on FIG. 2 this case is indicated by broken lines.

We claim:

1. A microphone arrangement comprising at least two individual microphones arranged in proximity to each other, said individual microphones depending on the recording angle desired for sound recording are at least one of a pressure, a pressure gradient receiver, or a directional line microphone, characterized in that the wind pressure is continuously measured during the sound recording by means of a microphone (Mw) with a downstream switched electronic circuit (5, 11, 12) and depending upon the respectively prevailing wind pressure one microphone of said at least two microphones always remains connected by means of an instantaneously controlled switch (6, 7, 8) to an amplifier (9) and said microphone corresponding to a conversion principle, frequency response and directionality is least sensitive to wind noises at the prevailing wind intensity.

2. Microphone arrangement according to claim 1, characterized in that the microphone measuring the wind pressure is a pressure receiver.

3. Microphone arrangement according to claim 1, characterized in that the microphone measuring the wind pressure is a pressure gradient receiver with cardioid-shaped directional effect.

4. Microphone arrangement according to claim 1, characterized in that the microphone measuring the wind pressure is one microphone of the at least two individual microphones of the microphone arrangement

* * * * *